United States Patent [19]

Hahn et al.

[11] 4,009,834

[45] * Mar. 1, 1977

[54] METHOD OF OPERATING BREAKER/CRUSHER

[75] Inventors: William F. Hahn, Devon; Carl R. Graf, Whitehall, both of Pa.; George H. Hart, New Castle, Maine

[73] Assignee: Pennsylvania Crusher Corporation, Broomall, Pa.

[ * ] Notice: The portion of the term of this patent subsequent to Jan. 13, 1993, has been disclaimed.

[22] Filed: Oct. 28, 1975

[21] Appl. No.: 626,600

Related U.S. Application Data

[63] Continuation of Ser. No. 417,335, Nov. 19, 1973, Pat. No. 3,931,937, which is a continuation-in-part of Ser. No. 267,936, June 30, 1972, abandoned.

[52] U.S. Cl. ..... 241/27; 241/74; 241/187; 241/189 R

[51] Int. Cl.[2] ..... B02C 13/06

[58] Field of Search ..... 241/27, 73, 74, 85, 241/86, 86.1, 86.2, 87, 87.1, 91, 178, 181, 183, 187, 189 R, 189 A

[56] References Cited

UNITED STATES PATENTS

| | | | |
|---|---|---|---|
| 1,458,486 | 6/1923 | Kloman | 241/178 X |
| 1,713,507 | 5/1929 | Ammon | 241/73 |
| 1,768,713 | 7/1930 | Prater | 241/73 |
| 1,784,983 | 12/1930 | Borton | 241/91 X |
| 1,855,379 | 4/1932 | Battey | 241/91 |
| 2,108,793 | 2/1938 | Borton | 241/87 X |
| 2,670,140 | 2/1954 | Douglas | 241/91 |
| 2,834,553 | 5/1958 | Neely | 241/91 X |
| 3,185,192 | 5/1965 | Delcellier | 241/178 X |
| 3,554,454 | 1/1971 | Gryendler | 241/73 |

*Primary Examiner*—Granville Y. Custer, Jr.
*Assistant Examiner*—Howard N. Goldberg
*Attorney, Agent, or Firm*—Pollock, Vande Sande & Priddy

[57] ABSTRACT

A method of operating a rotor-equipped breaker/-crusher for coal and other material in which the drum is rotated at close to critical speed, and in which lifter shelves in the drum are adjusted for dropping material into the path of the rotor at a point where the rotor not only fragments the material, but also emphasizes the flinging of the material against the downwardly moving perforated wall of the drum. Methods of this character enable a relatively small breaker/crusher to effectively duplicate the performance of much larger existing units, while successfully controlling the production of fines.

8 Claims, 10 Drawing Figures

FIG. 6
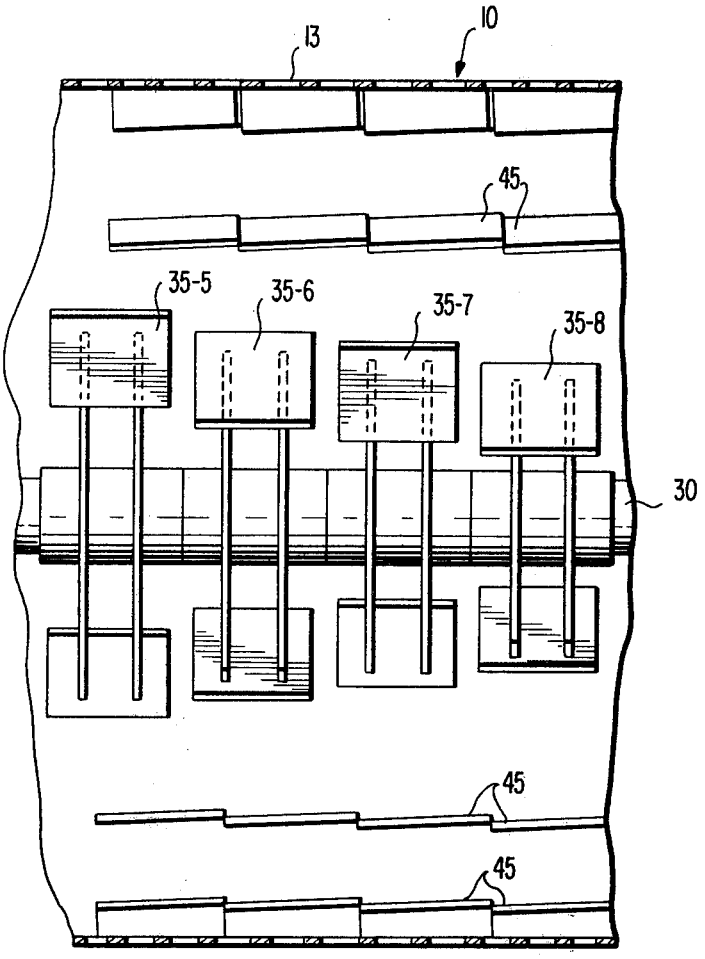
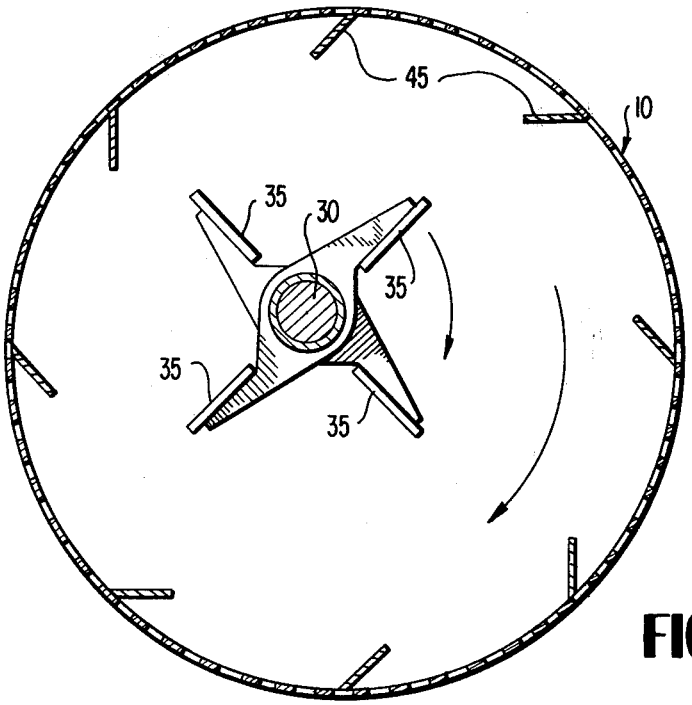
FIG. 7

FIG. 9
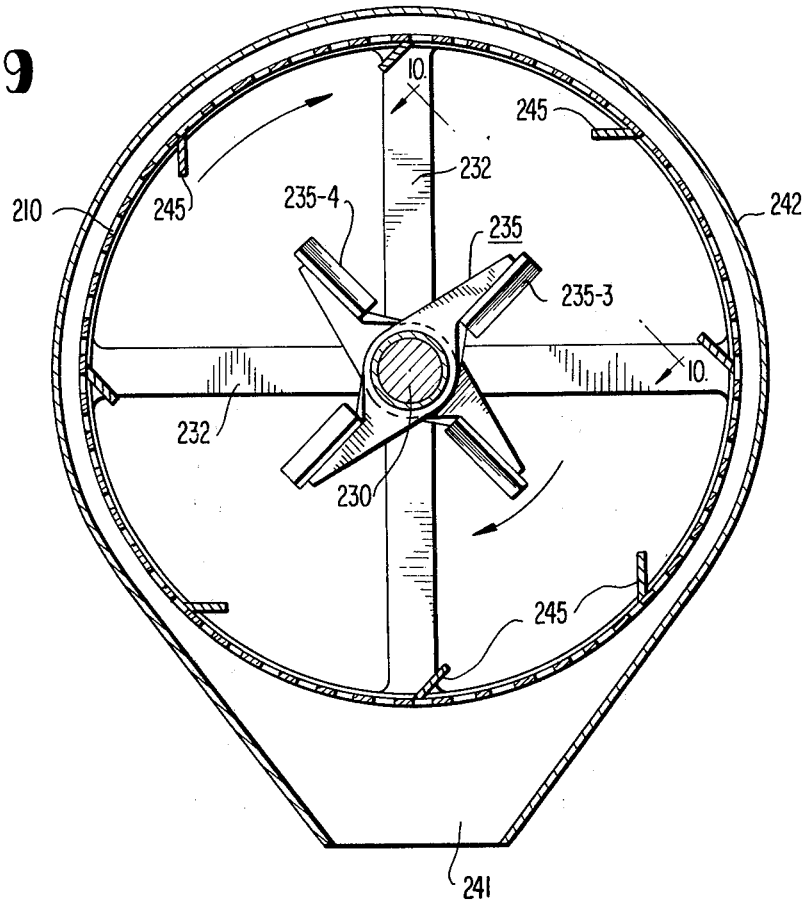
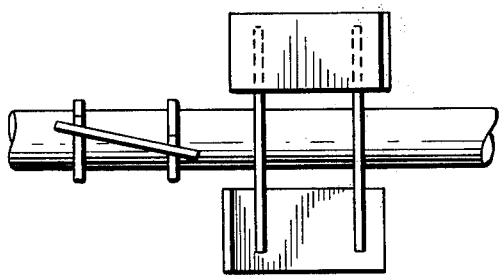
FIG. 10

METHOD OF OPERATING BREAKER/CRUSHER

CROSS REFERENCE TO RELATED APPLICATION

This application is a continuation of Ser. No. 417,335, filed Nov. 19, 1973, now U.S. Pat. No. 3,931,937, which in turn was a continuation-in-part of Ser. No. 267,936 filed June 30, 1972 which is now abandoned.

BACKGROUND OF THE INVENTION

Since the 1870's, when Hezekiah Bradford introduced them, Bradford Breakers have been made larger and larger to meet the ever increasing demands for greater operating capacity or through-put.

Bradford's breaker was a simple device for reducing and screening coal or other materials of similar breaking characteristics and for separation of unwanted materials. It was a perforated rotatable drum or cylinder with lifter shelves inside. When you looked into one end of a clockwise rotating breaker with a bed of coal in it, you could see the lifter shelves lifting successive portions of the bed. The drum rotated relatively slowly. In general, by the time a given shelf loaded with coal reached approximately the 10 o'clock position or approached the 11 o'clock position, it had tipped far enough to drop the coal back into the bottom of the cylinder generally at about the 6 o'clock position. The impact of the fall and the abrasion of pieces of coal in the bed against each other and against the perforated drum reduced the coal. Small pieces worked their way down through the bed and the perforations, while larger pieces and foreign materials received further treatment as they progressed towards the drum outlet.

Progress has never seemed rapid in this art. For about a half century after it was introduced, the form and operation of the Bradford Breaker changed little. Some improvements were however made during this period on details of shelf and drum design.

Perhaps the most significant improvement occurred in the late 1920's. George W. Borton, as described in his U.S. Pat. No. 1,784,983, mounted in the drum of the Bradford Breaker a rotor structure carrying hammers of the type previously used in rotary beaters or hammer crushers. The rotor was placed on the center line of the drum in such a position that materials falling off the shelves dropped in the path of the rapidly rotating hammers.

Borton recognized that one needed to select a proper speed for the drum so that the shelves would carry the material to the proper height before dropping it in the rotor. And he had a definite objective in mind. As he taught in U.S. Pat. No. 2,108,793, the essential point was to select a speed (and therefore a dropping point) which would result in the "hammers hurling the material tangentially against the inner wall of the drum at one point of engagement, and such material rebounding from the wall of the drum at another angle and dropping into the hammer zone for further reduction, which cycle of operation will be repeated until the desired combination has been effected." He also suggested that adjustable lifting shelves be used with the same object in mind. Thus, Borton taught the principle that one should select a combination of drum speed and lifter adjustment which would emphasize hitting the dropped coal upwards with the rotor so it would rebound off the drum and back into the rotor for repeated impact.

Borton's influence continues. Up to the present day, the above-mentioned principle is the fundamental guide in the design of rotor-equipped breakers. Notwithstanding further improvements in drums, lifters and driving systems, changes in basic principles of breaker design and operation occur very slowly in this art. Commercial units now under construction, bearing a remarkable resemblance to the apparatus Borton described more than 40 years ago in U.S. Pat. No. 1,784,983, silently testify to this fact. Unaware of the principles needed for large scale improvement of breaker/crusher performance, designers and manufacturers faced with the requirement of a high through-put installation, have scaled up machines in accordance with the old principle, or have used a number of smaller machines of the old design, notwithstanding the ensuing cumbersome construction, duplication of facilities, and economic penalties.

OBJECTS

It is an object of the present invention to avoid the problems of cumbersomeness, or duplication of facilities or economic penalty referred to above.

A further object of the present invention is to provide methods of operating breaker/crusher apparatus which enable the procurement of significantly larger through-put from a unit of a given size; or, in the alternative, equivalent production from a unit of smaller size.

Another object of the present invention is to operate a breaker/crusher of the modified Bradford type described hereinabove in such manner that the percentage of fines produced can be substantially less than that which has heretofore resulted from prior art machines and operations.

Another object is to provide a method of operating a modified Bradford Breaker/Crusher whereby materials of different hardness, different friability, and different breaking characteristics may be reduced to a desired size and, if desired, separated in a single pass through the machine.

These and other objects of the invention will become apparent to those skilled in the art upon consideration of the disclosure which follows.

SUMMARY OF THE INVENTION

The foregoing objects are achieved, in accordance with the teachings of the present invention, by certain improvements in the known method of operating a breaker/crusher apparatus comprising a rotating perforated drum having lifter shelves and having on the center or other longitudinal axis of the drum a rotor shaft carrying a plurality of paddles, hammers or other impacting means. In accordance with the present invention, the drum is rotated at a speed close to critical speed, i.e., close to the speed at which the material lifted by the shelves would be held by centrifugal force and not dropped therefrom. The direction and angle of the lifter shelves relative to the radial is so selected, relative to the rotating speed of the perforated drum, for carrying the material on the lifter shelves to about 11–12 o'clock position, the circular cross section of the drum and paddle circle being viewed as a clock face for purposes of this description. In accordance with prior practice, the material drops from the shelves a short selected distance into the path of the rotor. The rotor may be and preferably is operated at such a speed as to strike the falling material with an impact force designed to correspond to that force to which the material would have been subjected had it been dropped to the bottom of a drum of a selected larger diameter without a rotor. However, in accordance with the invention, because of the operating speed of the drum and the angle of the lifting shelves, they drop the material on to the rotor at such a point as to emphasize the flinging of material against the down-running wall of the perforated drum (between the 12 and 6 o'clock positions). This has several advantages. The flinging of material against the down-running wall of the drum reduces the tendency of material flung off by the rotor to strike the uprunning side of the drum and drop back into the bed. When material which is already sufficiently reduced drops back into the bed and is again lifted and dropped, energy and capacity are wasted. Minimizing this action provides improvements in operating efficiency and throughput. Moreover, when the flinging of material against the downrunning wall of the drum is emphasized, rebounding of particles off of or back through the drum and back into the rotor is reduced. Thus, material which is reduced to the proper size on the first impact following release from the lifter shelves is less likely to be subjected to a further unnecessary impact before it is screened through the drum perforations. Such unnecessary impacts can result in excessive reduction and unwanted fines. On the other hand, larger material, too large to sift through the openings in the cylinder wall, is subjected to one or more additional cycles of being lifted, dropped, hit by the rotor and further fractured until it passes out of the unit through the perforated drum. Here again, there is a reduced probability that a particle which has just been reduced to the proper size by the rotor will be further fractured prior to sifting through the drum. This enables close control on the degree of material separation, where desired, and/or size reduction with a minimum of fines content.

In a preferred way of practicing the invention, the rotor is provided with paddles located at different distances radially from the axis of rotation of the rotor shaft. The paddles located more remote from the input end are at longer distances radially from the rotor shaft and therefore move at higher speeds than the more inward paddles near the input end. Thus, materials which are harder and more difficult to fragment, and which may not be broken sufficiently by the slower moving paddles encountered first, are broken by the longer, faster-moving paddles. The latter, due to their higher tip speeds, deliver higher impact to the material, and it is possible to use paddles which are at progressively increasing radial distances from the rotor shaft to impart increasingly higher impact to the material as it progresses through the machine. Thus, material which is the most likely source of fines is reduced under lower impact forces, and materials of different hardness and mass characteristics can be successfully reduced in a single pass through the machine while holding fines production to a minimum.

BRIEF DESCRIPTION OF THE DRAWINGS

FIG. 6 illustrates a preferred method of practicing the present invention in which paddles of different radial lengths are provided.

FIG. 7 illustrates apparatus in which the rotor is displaced from the axis of the drum.

FIG. 9 is an elevational left end view of the machine of FIG. 8, looking along section line 9—9 of FIG. 8.

FIG. 10 is a sectional view looking along section line 10—10 of FIG. 9.

DETAILED DISCUSSION

Figure 1:
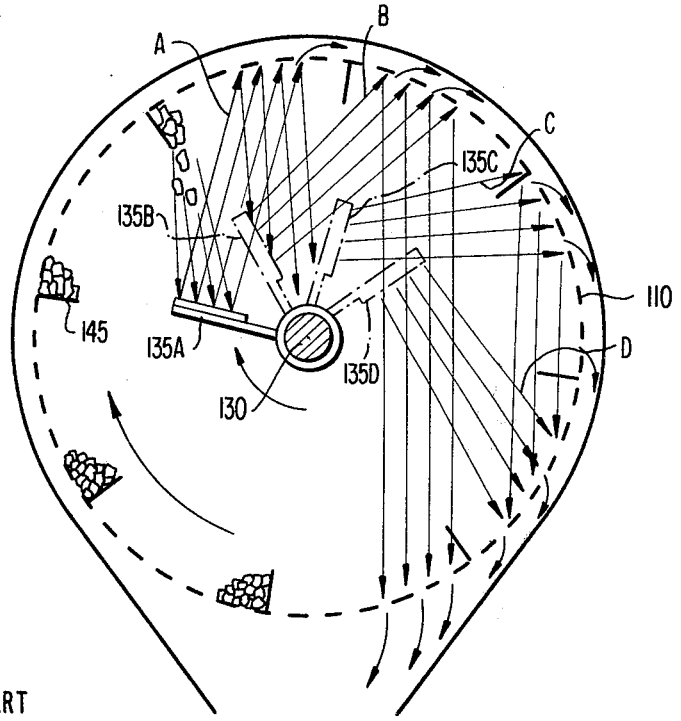
FIG. 1 PRIOR ART
FIG. 1 is a schematic diagram illustrating prior art methods of operating breaker/crushers.

FIG. 1 is offered as a schematic illustration of the mode of operation described in the above quotation from Borton's U.S. Pat. No. 2,108,793. In the prior art breaker depicted in FIG. 1, there is a perforated drum 110 with hammers, all of which are rotating in a clockwise direction as shown by successive full line and phantom line representations 135*a*, 135*b*, 135*c* and 135*d*. As Borton teaches, the speed of rotation of the hammers is substantially greater than that of the drum. Although breakers without rotors may turn somewhat faster, a conventional or usual speed of rotation for the drum 110 in a rotor-equipped coal breaker would be less than about 70% of critical. For purposes of this illustration, the lifter shelves 145 are shown as radially disposed, but it should be apparent that at the lower drum operating speeds generally prevailing in the prior art, the differences between the FIG. 1 prior art device and the invention would be accentuated if angled lifter shelves were provided in FIG. 1. The material lifted by the shelves 145 is dropped into the path of the rising hammers, such as indicated by the hammer 135A drawn with solid lines in FIG. 1. As a result, the material shattered by the hammer 135A is thrown upwardly against the upper wall of the rotating drum along paths indicated by the arrows A. This material drops into the path of the same or following hammer, indicated in phantom by hammer 135 B, where it is again struck and the further shattered pieces are again thrown against the wall of the drum 110, along paths indicated by the arrows B. This action is repeated, as indicated by hammer 135C and 135D, and material which has been again struck and again reduced is thrown along the paths such as indicated by the arrows C and D. The action just described produces an excessive amount of fines. In certain processes, this fine material is not useful unless it is compressed into pellet form. This can introduce severe economic penalties into certain types of installations, especially, for instance, coal gassification installations in which the void volume in the reactors must be carefully controlled (by avoidance of excessive fines in the feed) for the process to operate successfully. In such case, excessive production of fines in the breaker/crusher necessitates the installation of pelletizing equipment or at least more pelletizing equipment than would otherwise be necessary. Moreover, fines can be undesirable from the standpoint of pollution and public health.

Figure 2:
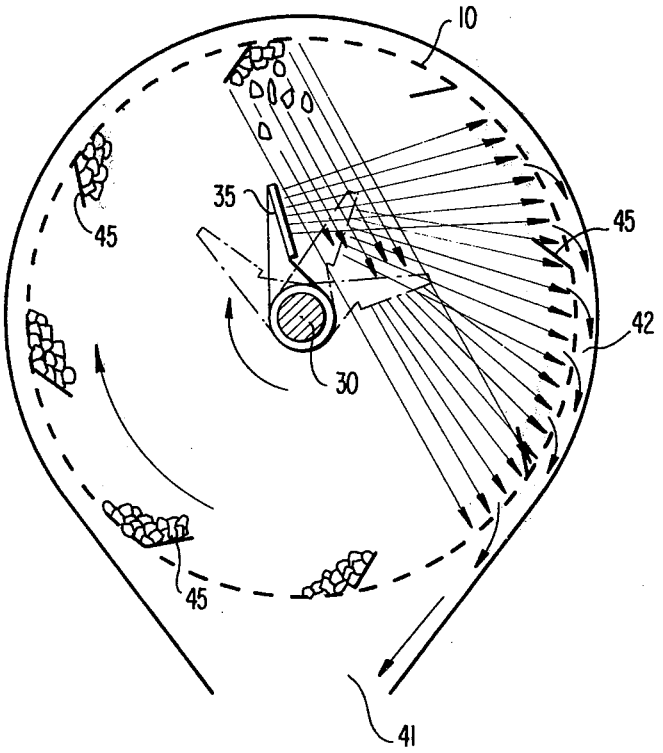
FIG. 2 is a schematic diagram illustrating the method of operation of the present invention.

The contrast between the prior art and the method of the present invention is illustrated schematically by FIG. 2. It is understood of course that the drum 10 will be connected to a driving means which will drive it at an appropriate speed for the mode of operation shown in FIG. 2. And as FIG. 2 clearly shows, the apparatus, including the setting of the lifter shelves, is arranged for dropping the material from the shelves 45 at or near the crest of their orbit, or at least at such point that the material first encounters the impact means 35, be they paddles, hammers or other members, at or near the crest of the orbit of the impact means. This sends significantly more of the impacted material to the right of the 12 o'clock position after initial impact. In other words, the major trajectory of the falling material is on the downrunning side of the rotor axis, whereby the falling material is struck by the rotor and flung against the downrunning wall of the drum. This in turn tends to reduce unneeded impacts between smaller pieces and the rotor, as well as other screening advantages discussed above, in the summary of invention.

In the practice of the invention, the drum 10 is rotated at a relatively fast speed compared to conventional practice in rotor-equipped Bradford Coal Breakers, e.g. about 70% to less than 80% of critical speed, but more preferably at 80–95% of critical speed. If the drum speed is too slow, the material will not be carried high enough before being dropped into the rotor, thus resulting in the type of operation sought after by Borton, which has been described under Background of the Invention, above.

Further benefits may be obtained by proper selection of rotor speed. Heretofore, rotor speed selection in most Bradford Breakers has been tailored to the breaking characteristics of the relatively harder rocks generally found in unprepared coal. Thus, the impact forces are much greater than are required for the coal itself; and subjecting the coal to such impact forces can also be a factor in producing excessive fines. Thus, in accordance with the present invention, the rotor is equipped with means for driving at least a portion of it at a relatively slow speed compared with prior art rotors. This speed, although perhaps too slow in most cases to break all of the rock components of the coal to the size of the drum perforations, provides impact equivalent to that required to break the coal by gravity impact alone. Thus, for example, the rotor might be rotated at a predetermined speed in the range of 50–300 rpm.

Figure 3:
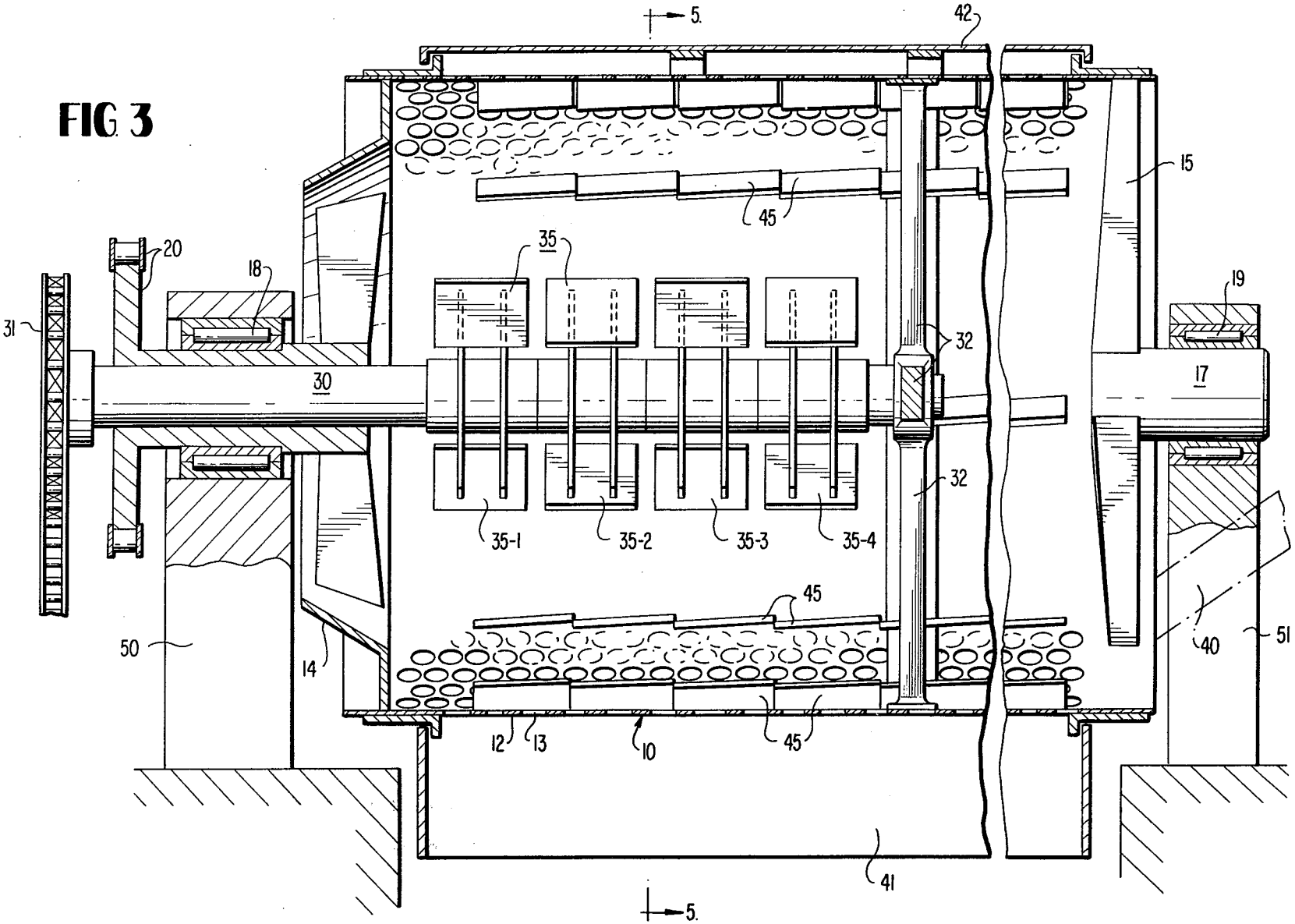
FIG. 3 is an elevational view, partly in section, of a breaker/crusher machine, used in practicing the present invention.
Figure 4:
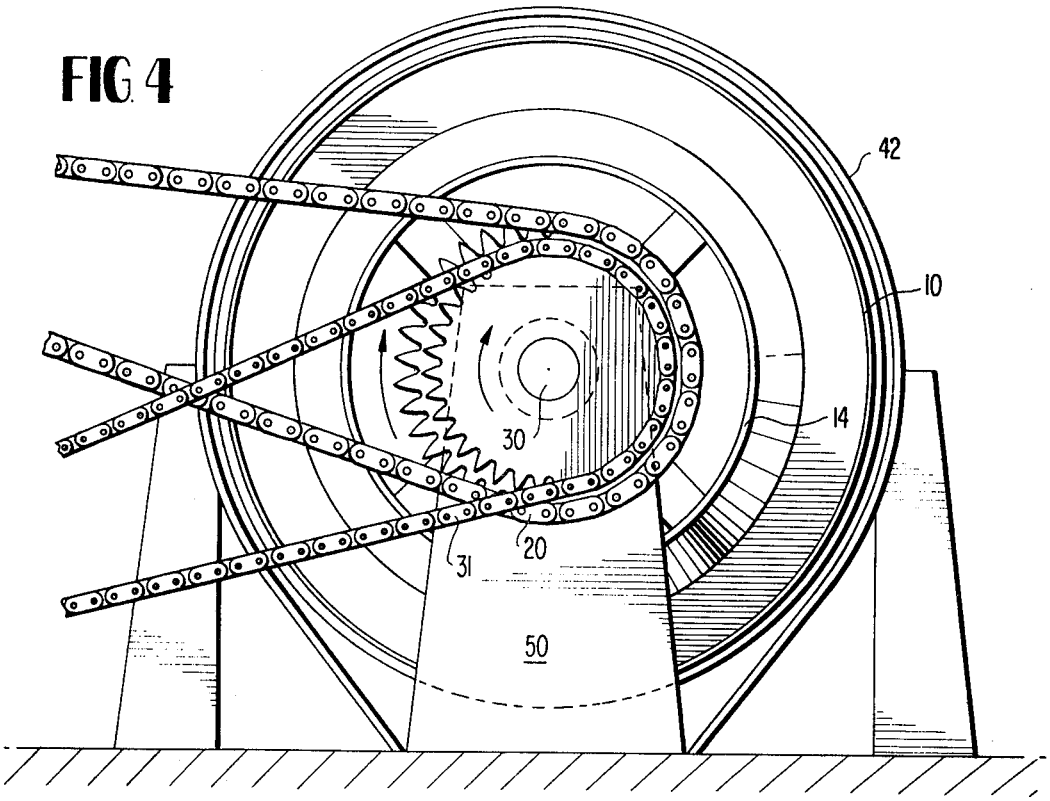
FIG. 4 is an elevational left end view of the machine of FIG. 3.
Figure 5:
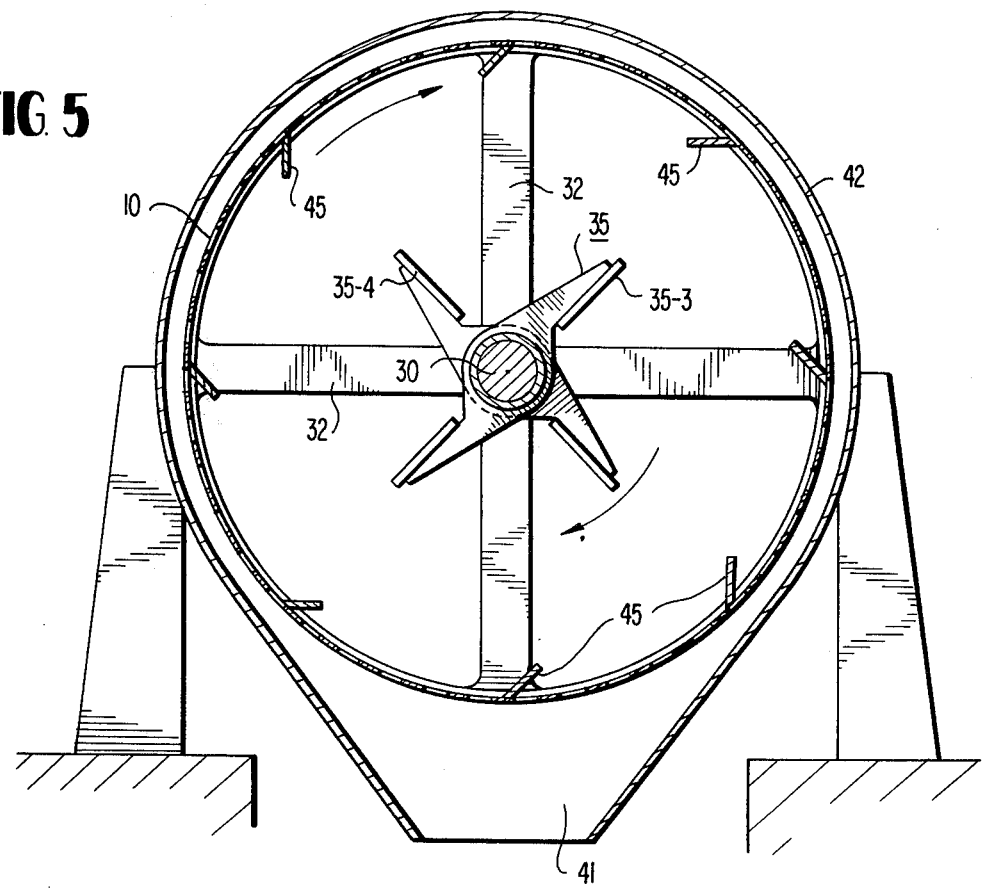
FIG. 5 is a sectional view looking along section line 5—5 of FIG. 3.

Referring now to FIGS. 3–5, the breaker crusher there shown includes a hollow drum or cylinder 10 having a wall 12 having openings 13 therein of a size and shape to allow passage therethrough of material of that size and shape which it is desired to collect in the exit or discharge chute 41 which is part of the drum enclosure 42 and is located beneath the drum. At the right end of drum 10 is a spider 15 having radial legs whose outer ends are secured to the drum 10. Spider 15 provides openings through which coal, or other material to be reduced, is fed to the interior of the drum, as by a feed chute 40. The inner ends of the radial legs of spider 15 are secured to, and rotatably supported by, a pinion 17 journalled in bearings 19 in a pedestal block 51. The left end of drum 10 is supported by an end member 14 which is secured to and supported on a hollow pinion 16 journalled in bearings 18 in a pedestal block 50. Hollow pinion 16 is driven rotatably by a chain-and-sprocket drive 20. Since pinion 16 is secured to end member 14, which is secured to the right end of drum 10, it will be seen that drum 10 is driven rotatably by the chain-and-sprocket drive 20.

Within the hollow bore of pinion 16 is a rotor shaft 30 the inward end of which is supported in a spider 32 located within the drum 10. The outer ends of the legs of spider 32 are secured to the wall 12 of the drum. Rotor shaft 30 is driven by a chain-and-sprocket drive 31.

The means illustrated and described above for driving drum 10 and rotor shaft 30, merely represent one of several ways in which drum 10 and shaft 30 may be driven. So far as the present invention is concerned, any suitable means may be employed for driving separately the drum 10 and the rotor shaft 30.

Rotor shaft 30 carries a plurality of sets of paddles 35. Four sets are illustrated in FIG. 3. As seen in FIG. 5, each set of paddles 35 consists of two paddles disposed at 180° separation. The alternate sets of paddles, such as 35-1 and 35-3 (FIG. 3), are 90° out of phase with the other two alternate sets of paddles, 35-2 and 35-4. This is clearly seen in FIG. 5.

Spider 32 which supports the inner end of rotor shaft 30 may be located at the longitudinal center of the drum 10 or at any other desired location, depending upon how much of the overall length of the drum is to be provided with paddles 35. In some cases, the rotor shaft 30 may extend for the entire axial length of the drum. In FIG. 3, it has been assumed that the rotor shaft 30 and the paddles 35 are located only at the end portion of the drum 10 remote from the input end.

Secured to the inner surface of wall 12 of drum 10 throughout the entire length of the drum are sets of lifter shelves 45. These shelves 45 are inclined both axially and radially. The shelves are inclined slightly downwardly axially in a direction to cause the material to progress from the input end of the drum toward the opposite end. The shelves 45 are also inclined downwardly off the radial in a direction opposite to the direction of drum rotation, as seen in FIG. 5. The angle of inclination departs from the radial by a substantial amount, e.g. about 25°–70°, but preferably of the order of 45° – 60°.

In FIGS. 3–5, and in other of the figures of drawing, the lifter shelves 45 have been shown as inclined longitudinally, and discontinuous but in a straight line. In some cases, it may be desirable to stagger the position of the lifter shelves.

In one machine which has been built and tested, the lifter shelves 45 were located in straight longitudinal lines, as in FIG. 3, at a 60° angle of inclination away from the radial. The shelves had a width of 6 inches. The drum 10 was 7 feet 1 inch in diameter and was rotated at 21–25 r.p.m. The perforations 13 were 1¼ inches in diameter. The rotor shaft 30 was operated at 116–120 r.p.m. The paddles 35 were square, 1 foot on each side. The paddle circle was 3 feet in diameter.

In FIG. 3, which illustrates one preferred form of machine, the drum 10 is shown to be supported at one end by a spider 15 on a trunnion 17. This, of course, is not essential. The shaft 30 could extend all the way through the drum, with paddles occupying only a portion of the length, if desired, and the drum 10 could be peripherally supported on wheels.

In the drawings, the alternate sets of paddles, such as 35-1 and 35-3, are shown to be 90° out of phase with the other alternate sets of paddles, such as 35-2 and 35-4, but this relation could, of course, be varied.

Similarly, while the two paddles of each set are shown to be 180° out of phase, this relationship could be varied, as could also the number of paddles per set. Three or four more paddles may be applicable in softer materials where the speed of the paddle may be slower relative to its diameter.

FIG. 6 illustrates a modified apparatus which permits materials of different hardness and different breaking characteristics to be reduced to desired size and, if desired, separated in a single pass through the machine. FIG. 6 corresponds to a fragmentary portion of FIG. 3, being that portion to the left of the spider 32 which supports the rotor shaft 30. In FIG. 6, rotor shaft 30 carries a plurality of sets of paddles, four sets being shown, identified as 35-5, 35-6, 35-7 and 35-8. Each set consists of two paddles at 180° spacing but the paddles of each set are at a progressively different distance radially from the axis of rotor shaft 30, so that each set of paddles defines a paddle circle of a different diameter. The set of paddles 35-8 nearest to the input end of the drum 10 is closest to the rotor axis and defines the smallest paddle circle. The set of paddles 35-5 farthest from the input end of the drum is farthest from the rotor axis, and defines the largest paddle circle. As the material in drum 10 of FIG. 6 progresses through the drum, from right to left, the harder materials which are not broken, or not broken sufficiently, by the paddles 35-8 or 35-7, which have the smaller paddle circles, will be broken by the other paddles 35-6 or 35-5 which, being farther from the center axis of the rotor shaft are moving at faster speed imparting a greater impact than the previously traversed paddles.

While not illustrated, another way of providing more than one paddle speed is to provide a quill shaft over a portion of the rotor shaft, for example, over the left end portion, and to mount the left end set or sets of paddles on the quill shaft, and drive the quill shaft at a faster rate of rotation than the rotor shaft.

FIG. 7 is a schematic illustrating another modification in which the paddle rotor shaft 30 is off the center axis of the drum 10. In some installations, it may be desirable to locate the paddle circles in, for example, one of the upper quadrants of the drum circle. In FIG. 7, the paddle circle has been moved slightly towards the upper left quadrant. This assures that the material which falls from the lifter shelves 45 at the crest of the shelf circle will fall to the right of the rotor shaft 30 and will be struck, reduced and propelled toward the lower right quadrant of the drum 10.

Figure 8:
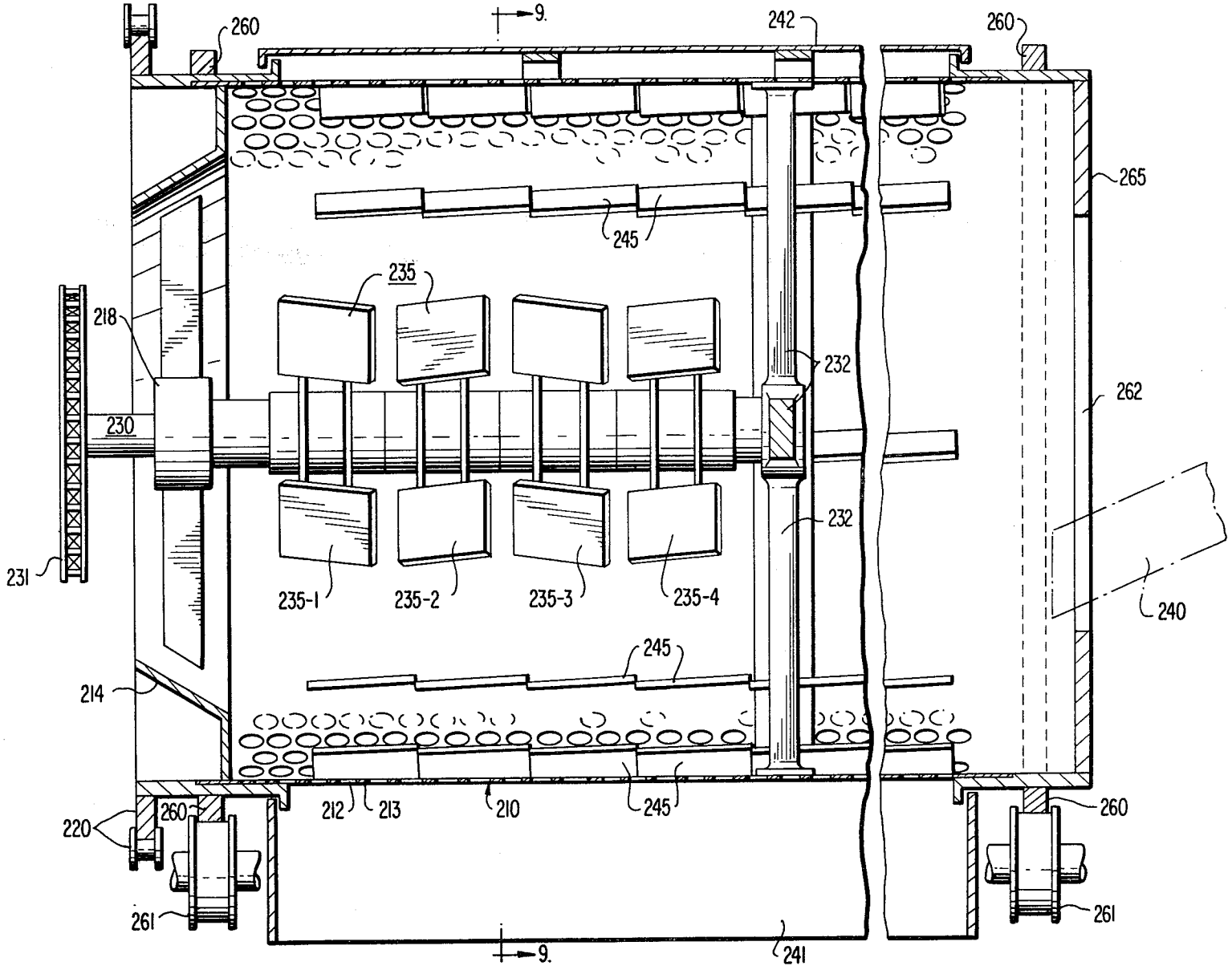
FIG. 8 is an elevational view, partly in section, of the most preferred method of operating a breaker/crusher machine according to the present invention.

Turning now to the most preferred embodiment of the invention shown in FIGS. 8–10, the breaker/-crusher shown therein includes a hollow drum or cylinder 210 with wall 213 and screening openings 212 through which screened material exits to discharge chute 241 in enclosure 242. At least the inlet end, but preferably both ends of the drum are provided with tracks 260 and cooperating, supportive wheel assemblies 261 rotatably mounted in fixed supports (not shown). This makes possible a large unobstructed opening 262 in the drum end plate 265, through which enters the feed chute 240, shown in phantom outline. This feature, as well as the spacing of the rotor shaft 230 and supporting spider 232 inwardly from opening 262 affords the opportunity of introducing very large pieces of feed material into the apparatus. This apparatus has the left end of its shaft 230 supported by end member 214 and bearings 218. Shaft 230 and the drum are driven by chain and sprocket drives 231 and 220 respectively.

On shaft 230 are a plurality of sets of impacting means which may be of uniform radius, but are preferably of gradually increasing radius commencing with the set 235-4 and progressing to set 235-1, which is closest to the discharge end of the apparatus. The apparatus is also provided with lifters 245 which may be at an angle of 0° – 70° from the radial, preferably about 25° – 70° downwardly inclined from the radial, and most preferably about 45° downwardly, as viewed on the upcoming wall of the drum as shown in FIG. 9. The lifters 245 may, if desired, be segmented and pitched as shown in FIG. 8 so as to urge feed material along the drum from the inlet end to the outlet end.

A particularly valuable feature of this embodiment is the pitching of the striking surfaces of the impacting means 235-1 to 235-4 on the rotor in such a manner as to throw the material impacted by the rotor progressively towards the outlet end of the apparatus, which in this case is the left end of drum 10.

In a Bradford Breaker, there is a certain amount of production of fines which is attributable to the autogenuous effect, i.e. the attrition of particles of coal in the tumbling bed in the breaker resulting from abrasion of said particles against each other and against the interior of the drum, lifting shelves, and other parts of the apparatus. The pitch of the impactor surfaces and the resultant throwing of material towards the discharge end of the apparatus provides a way of hastening the movement of material to downstream portions of the drum where more screening capacity is likely to be available.

The foregoing embodiments have not been given for the purpose of limiting the invention. They are intended to be illustrative only, and it should be understood that the invention can be embodied in a wide variety of forms without departing from the spirit of the invention.

What is claimed is:

1. In a method for reducing coal and other materials, in apparatus including a hollow rotatable drum having an opening therein to receive feed material and wall means including screening openings to discharge material of desired size, lifter shelves positioned on the inner surface of said wall means for lifting and dropping material within the drum as the drum is rotated, and rotor means including a rotor shaft and shaft-mounted material impacting means positioned within at least a portion of the length of the drum for impacting material dropped from said shelves, the improvement which comprises:

a. driving said drum at a speed in the range of about 70% to about 95% of critical speed;

b. maintaining said lifter shelves on the drum at predetermined angle of inclination, ranging from 0° up to 70° in a direction opposite to the direction of drum rotation, which angle will cause said material to drop from said shelves into contact with said impacting means at or near the crest of the orbit of the impacting means when said drum is rotated at said speed, and which will direct the material from above one side of the rotor shaft to the other side of the rotor shaft in the direction of the downrunning side of said rotor shaft; and c. driving said drum and rotor in the same direction of rotation, whereby material struck by said rotor is flung against the downrunning wall of said drum.

2. Method according to claim 1 characterized in that said drum is driven at a speed which is at least about 70% but less than 80% of critical speed.

3. Method according to claim 1 characterized in that said drum is driven at about 80 to 95% of critical speed.

4. Method according to claim 1 characterized in that said lifter shelves are maintained at a downward inclination from the radial as viewed on the uprunning side of the drum.

5. Method according to claim 1 characterized in that the lifter shelves are maintained at a downward inclination from the radial, as viewed on the uprunning side of the drum, in the range of 25°–70°.

6. Method according to claim 1 characterized in that said impacting means includes a set of paddles mounted on the rotor shaft and impacted material is thrown progressively towards the outlet end of the drum by pitched surfaces of said paddles.

7. In a method for reducing coal and other materials, in apparatus including a hollow rotatable drum having an opening therein to receive feed material and wall means including screening openings to discharge material of desired size, lifter shelves positioned on the inner surface of said wall means for lifting and dropping material within the drum as the drum is rotated, and rotor means including a rotor shaft and shaft-mounted material impacting means positioned within at least a portion of the length of the drum for impacting material dropped from said shelves, the improvement which comprises:

a. driving said drum at a speed in the range of about 80% to about 95% of critical speed;

b. maintaining said lifter shelves inclined from the radial in a direction opposite to the direction of drum rotation at an angle which will cause said material to drop from said shelves substantially only when said shelves are at or near the crest of their circular orbit when said drum is rotated at said speed, and which will direct the material from one side of the rotor shaft to the other side of the rotor shaft; and c. driving said drum and rotor in the same direction of rotation, whereby material struck by said rotor is flung against the downrunning wall of said drum.

8. In a method for reducing coal and other materials, in apparatus including a hollow rotatable drum having an opening therein to receive feed material and wall means including screening openings to discharge material of desired size, lifter shelves positioned on the inner surface of said wall means for lifting and dropping material within the drum as the drum is rotated, and rotor means including a rotor shaft and shaft-mounted material impacting means positioned within at least a portion of the length of the drum for impacting material dropped from said shelves, the improvement which comprises:

a. driving said drum at a speed in the range of about 80% to about 95% of critical speed;

b. maintaining said lifter shelves inclined at an angle in the range of 25° to 70° downwardly from the radial, as viewed on the uprunning side of the drum, which will cause said material to drop from said shelves substantially only when said shelves are at or near the crest of their circular orbit when said drum is rotated at said speed, and which will direct the material from above one side of the rotor shaft to the other side of the rotor shaft in the direction of the downrunning side of said rotor shaft; and c. driving said drum and rotor in the same direction of rotation, whereby material struck by said rotor is flung against the downrunning wall of said drum.

* * * * *